United States Patent [19]

Miller

[11] Patent Number: 4,534,554

[45] **Date of Patent: * Aug. 13, 1985**

[54] FULL BODY WEIGHT TRACTION DEVICE

[75] Inventor: Jack V. Miller, Sierra Madre, Calif.

[73] Assignee: Gravity Guidance, Inc., Duarte, Calif.

[ * ] Notice: The portion of the term of this patent subsequent to Oct. 18, 2000 has been disclaimed.

[21] Appl. No.: 542,220

[22] Filed: Oct. 14, 1983

Related U.S. Application Data

[63] Continuation of Ser. No. 291,064, Aug. 7, 1981, Pat. No. 4,410,176.

[51] Int. Cl.[3] ..... A63B 17/00

[52] U.S. Cl. ..... 272/144; 272/145; 297/326; 297/457; 128/75

[58] Field of Search ..... 272/144, 145, 62, 33 R; 128/25 R, 24 R, 71, 75

[56] References Cited

U.S. PATENT DOCUMENTS

| | | | |
|---|---|---|---|
| D. 269,701 | 7/1983 | Miller | 128/75 |
| 1,693,810 | 12/1928 | Daniels et al. | 272/144 X |
| 1,904,039 | 4/1933 | Bruder | 272/144 X |
| 3,152,802 | 10/1964 | Heisler et al. | 272/33 R |
| 3,286,708 | 11/1966 | Gartner | 128/24 R |
| 3,380,447 | 4/1968 | Martin | 272/62 |
| 3,707,285 | 12/1972 | Martin | 272/144 |
| 3,716,231 | 2/1973 | Martin | 272/144 |
| 4,232,662 | 11/1980 | Barber | 272/144 |

*Primary Examiner*—Richard J. Apley
*Assistant Examiner*—S. R. Crow
*Attorney, Agent, or Firm*—Zarley, McKee, Thomte, Voorhees & Sease

[57] ABSTRACT

A tilt bed exercise device for rotating a human into inverted posture is provided with a pair of pivot bearings holding a rotatable tilt bed comprising a human torso conforming support with a beam extending therefrom and terminating in a rail canted at an angle wherein the proximal end of the rail is anterior of the user's ankles and the distal end is posterior to the user's ankles. A foot supporting means is slidably attached to the canted rail with selectable fixed locations suitable for different size humans. The user's ankles are held by supporting means including a hook on each ankle support engageable with the foot supporting means. A pivot stop is provided for the tilt bed wherein the foot supporting means is rotated past the vertical plane through the axis of the pivot bearings.

2 Claims, 11 Drawing Figures

FULL BODY WEIGHT TRACTION DEVICE

This is a continuation of application Ser. No. 291,064 filed Aug. 7, 1981, now U.S. Pat. No. 4,410,176.

BACKGROUND OF THE INVENTION

This invention relates to exercise devices for rotating a human user in oscillation and into inverted posture. This type of device is known and is described in U.S. Pat. No. 3,707,285 (Martin), U.S. Pat. No. 3,716,231 (Martin) and U.S. Pat. No. 4,232,662 (Barber). Ankle holding devices are also known and are destined in U.S. Pat. No. 3,380,447 (Martin) and my co-pending applications, Ser. Nos. 203,707 and 203,336.

The currently known configurations of tilt beds are subject to problems related to the size (and hence weight) of the user. When currently known tilt beds are fully inverted with a user, the foot supporting means passes across the vertical plane through the pivot bearings where the center of gravity of the combined user and tilt bed structure are far enough past the pivot bearings to securely hold the user in inverted posture. The foot supporting means on such known devices are adjustably mounted on a straight rail wherein a larger user is supported when inverted from a point further past the pivot bearing plane than a smaller person. As a result of this inherent geometry a taller (and hence heavier) person tends to lock more solidly into the inverted orientation, and a shorter (and hence lighter) person has difficulty staying inverted. This is a serious shortcoming, since there is some tendency towards panic if the tall user has difficulty in getting out of the inverted posture, and the device is obviously useless to a small person who cannot stay inverted.

SUMMARY OF THE INVENTION

This invention provides a tilt bed exercise device in which users of any size can achieve inverted posture and can also get out of inverted posture with ease.

The structure of a tilt bed must be such that it can support the human body sufficiently close to the center of gravity that the user can oscillate the bed and get into inverted posture by only using arm movements. This means that the bed alone has a rather strong tendency to right itself from inverted orientation, since the bed structure supporting the human torso is posterior to the torso, and therefore the center of gravity of the bed is also posterior to the pivot axis. When not supporting a human the bed is strongly self-erecting, and becomes substantially neutral with the addition of the user's center of gravity anterior to the the pivot axis. By shifting the weight of the arms, the user may alter the combined center of gravity to be entirely anterior to the pivot axis, and thereby achieve inversion.

An object of the invention is to have the ability to control the shifting of the combined center of gravity of the bed and users of varying physical size.

Another object of the invention is to provide a tilt bed in which substantially all users can achieve inverted posture and can recover from inverted posture with similar ease.

The objects of the invention are achieved by providing a tilt bed in which users of various sizes, when in inverted posture, have substantially the same rotational moment applied against a rotational limit stop.

DETAILED DESCRIPTION OF THE DRAWINGS

Figure 1:
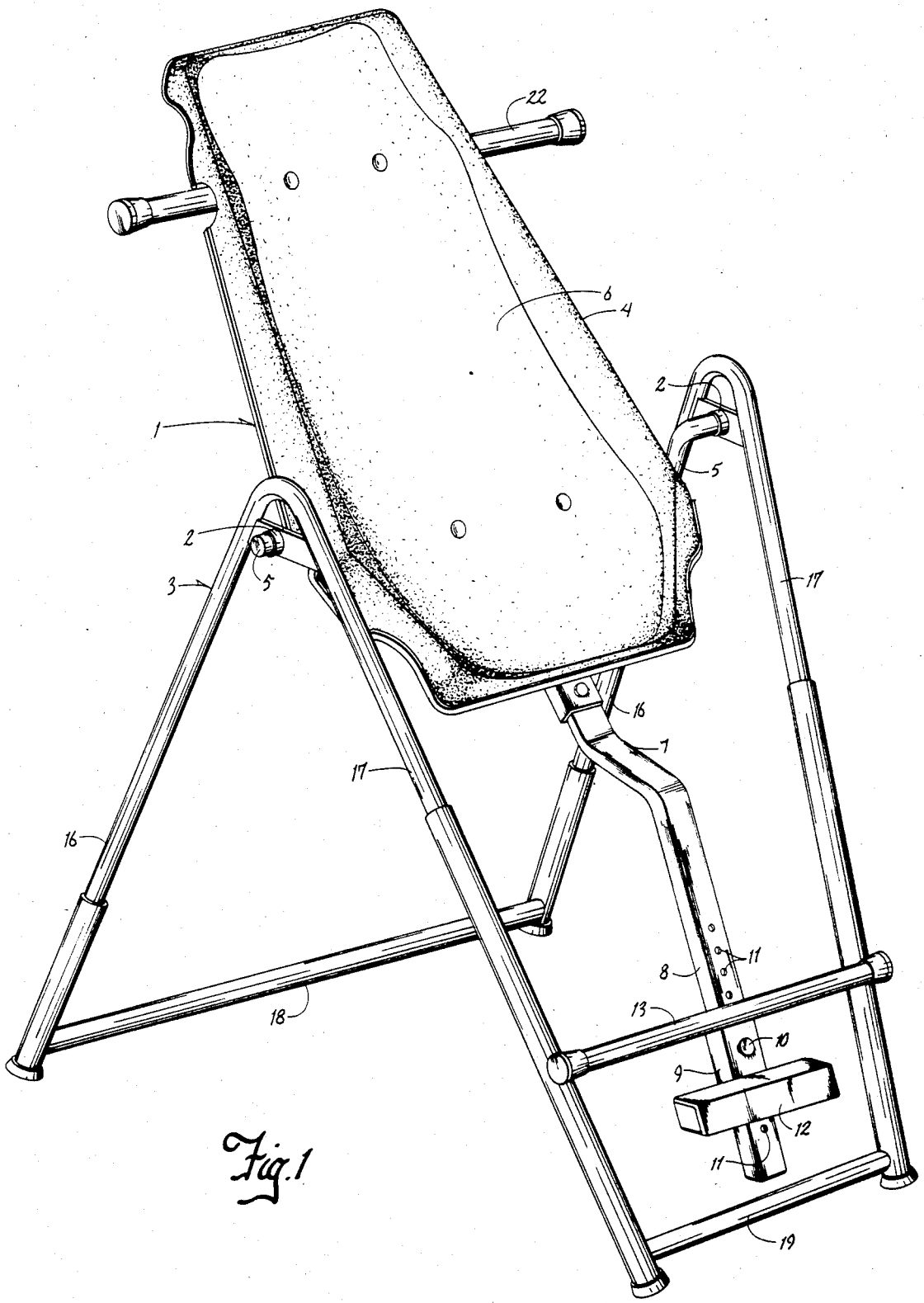
FIG. 1 is a perspective view of a tilt bed exercise device according to the invention.

In FIG. 1 a tilt bed exercise device 1 is shown having pivot bearings 2 supported by a frame structure 3. A tilt bed 4 is supported within pivot bearings 2 on bearing journals 5 at approximately the longitudinal mid-point of tilt bed 4. Tilt bed 4 includes a torso support 6, which is sized and configured to generally match the size and shape of a human torso. A beam 7 extends from the lower central portion of torso support 6 and terminates in a canted rail section 8, on which a foot support 9 is slidably disposed. A lock 10 is provided to engage any of a series of discrete adjustment stops 11 in order to locate the foot support 9 properly for users of different sizes. The foot support 9 is provided with a foot rest 12 and a foot bar 13. Pivot bearings 2 are held in co-axial relationship parallel to a floor surface by a pair of posterior legs 16 a pair of anterior legs 17. A cross brace 18 joins the lower extremity of each leg 16 and a width greater than the distance between pivot bearings 2, and a cross brace 19 joins the extremity of each leg 17 at a width less than the distance between pivot bearings 2. A stop bar 22 is provided with a length greater than the transverse distance between the anterior legs 17 and less than the transverse distance between the posterior legs 16, whereby upon rotation of the tilt bed the stop bar will pass through legs 16 and stop on legs 17.

Figure 2:
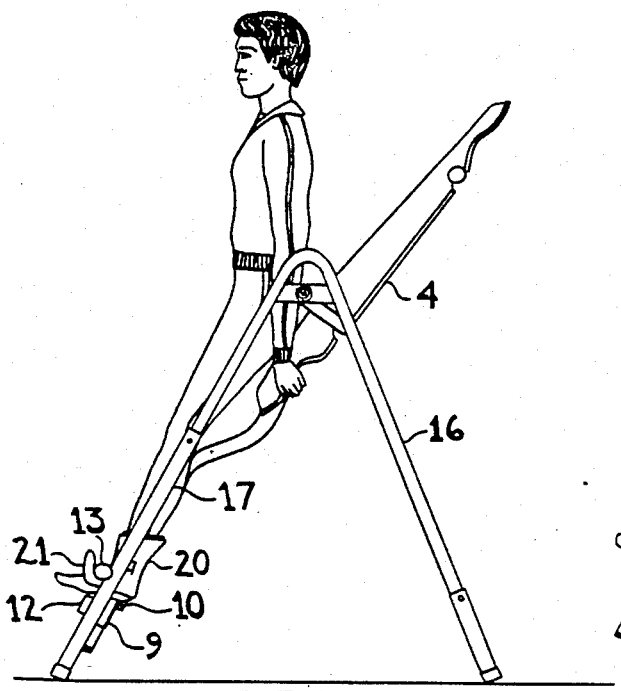
FIG. 2 is a side elevation view of the tilt bed of FIG. 1 showing a user is generally upright posture.

In FIG. 2 a user is shown in a tilt bed 4 with foot support 9 adjusted by lock 10 for the approximate height of the user. The users feet are resting on foot rest 12, with the metatarsal arch disposed between foot rest 12 and foot bar 13. Clamped about the user's ankles are ankle supporting devices 20 which are provided with hooks 21 partially enveloping foot bar 21 to prevent the user from falling in partial or fully inverted postures.

Figure 3:
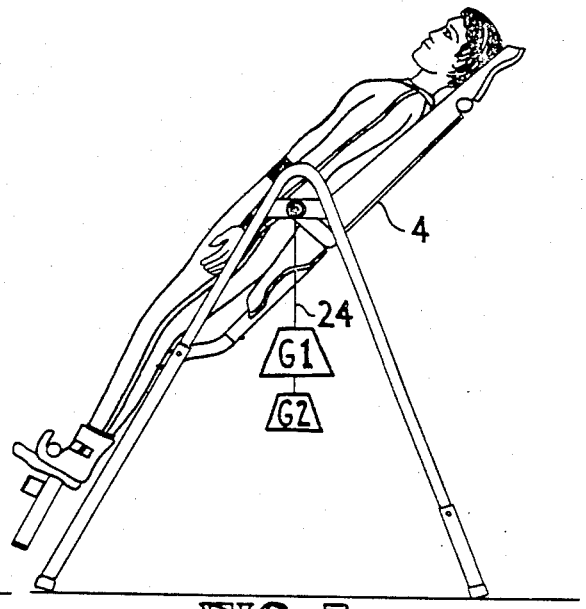
FIG. 3 is a side elevation view of the tilt bed and user of FIG. 2 in a neutral balanced orientation.

In FIG. 3 the user is resting on the tilt bed 4 in a neutral balanced condition wherein the center of gravity of the user, shown as $G_1$, and the center of gravity of the tilt bed, shown as $G_2$, are coincident and in the vertical plane through the pivot axis 24.

Figure 4:
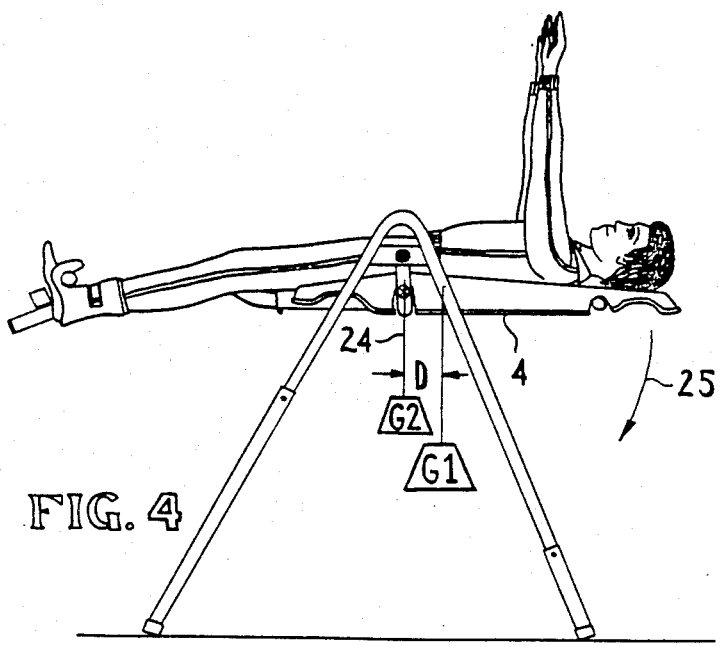
FIG. 4 is a side elevation view of the tilt bed and user of FIG. 2 in which the user is initiating rotation towards inverted posture.

In FIG. 4 the user is shown having raised his arms and thereby has shifted his center of gravity $G_1$ a distance D from the pivot axis plane 24, causing the tilt bed 4 and user to rotate in direction 25. In the orientation shown the tilt bed center of gravity $G_2$ remains approximately in the pivot axis plane 24.

Figure 5:
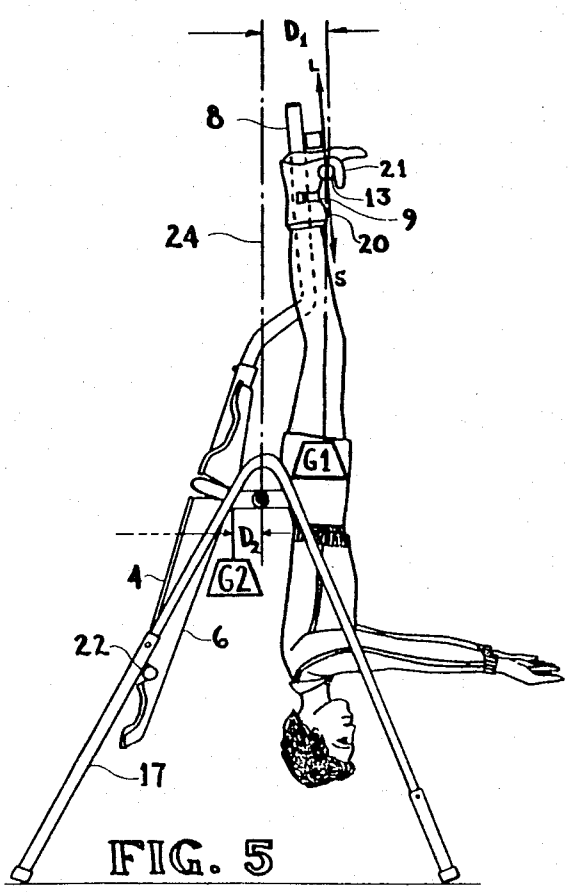
FIG. 5 is a side elevation view of the tilt bed and user of FIG. 2 in which inverted posture has been achieved.

In FIG. 5 the user is shown having rotated to a fully inverted posture wherein he is supported entirely by the engagement of the hooks 21 of ankle supporting devices 20 onto foot bar 13. At this point the user is completely free of the torso support 6 of tilt bed 4, and is prepared for stretching and exercising in inverted posture. The user's center of gravity $G_1$ is displaced a distance $D_1$ from the pivot axis plane 24 sufficiently to locate the stop bar 22 against the posterrior legs 17. The center of gravity $G_2$ of the tilt bed 4 is displaced a small distance $D_2$ which provides a limited moment tending to rotate the bed to the erect position, but the product of $G_1$ times $D_1$, being greated then the product of $G_2$ times $D_2$ keeps the tilt bed and user fully in the inverted posture. If the user swings or pushes his body posteriorly towards the vertical plane of the pivot axis, $D_1$ may be reduced sufficiently to make the product of $G_1$ times $D_1$ less than the product of $G_2$ times $D_2$, and hence cause rotation to the upright posture. Since $G_2$ and $D_2$ are constant in the inverted position, then to maintain stability for user of various weights, ie: various values of $G_1$, $D_1$ is varied inversely with $G_1$, keeping the product of $G_1$ times $D_1$ also approximately constant. In general, large people are heavier than small people. A person over 6 feet tall normally would weigh approximately 200 pounds, where a person under 5 feet tall would weigh approximately 100 pounds. Foot support 9 is adjustable along rail 8 along the canted line L-S. Near the extreme adjustment L for large persons $D_1$ is significantly smaller then near the extrme adjustment S for smaller persons. The angle of the canted rail 8 is sufficient to vary $D_1$ a factor of 2 over the adjustment range of line L-S, maintaining the balance within limits for nearly all user sizes, whereby nearly any user employing ankle supporting means 20 with the hooks 21 engaged upon the foot supporting bar 13 may exercise with considerable mobility without accidently releasing from inverted posture.

Figure 6:
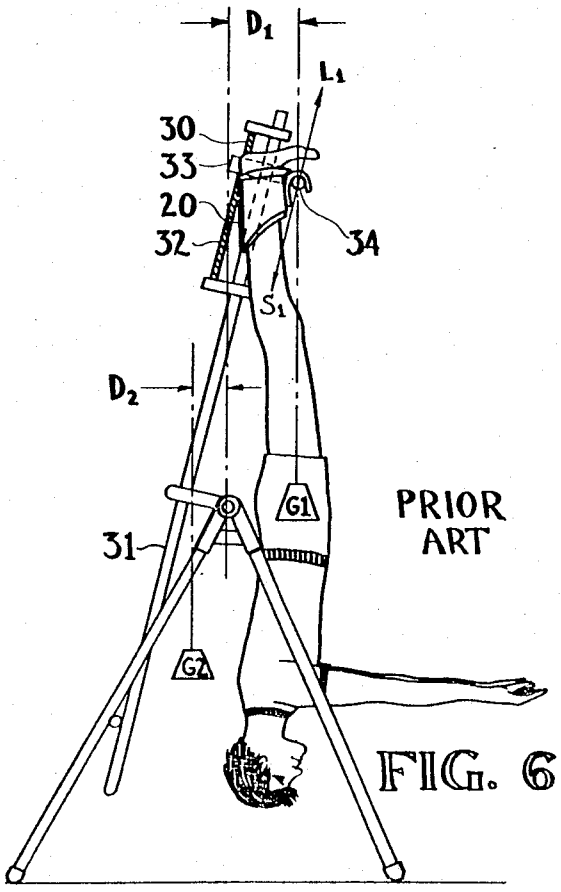
PRIOR ART FIG. 6
FIG. 6 is a side elevation view of a tilt bed of prior art and showing the range of adjustment for user size.

In FIG. 6 the geometry of prior art devices is shown, in which a beam 30 is a straight line extension of the structure of a prior art tilt bed 31. An adjustment means 32 is typically provided which adjusts a foot support 33 carrying a foot bar 34 along line $L_1$-$S_1$ to adjust for the difference in size of the users. With adjustments in direction $L_1$ there is a proportional increase in $D_1$ for users of greater weight. Conversely, with adjustment in direction $S_1$ there is a proportional decrease in $D_1$ for users of lesser weight. As a result, the product of $D_1$ times $G_1$ for a large person is much larger than for a smaller person. Since the product of $G_2$ times $D_2$ remains a constant, a large person has difficulty returning from inverted posture; and a smaller person sometimes cannot achieve inverted posture at all.

Figure 7:
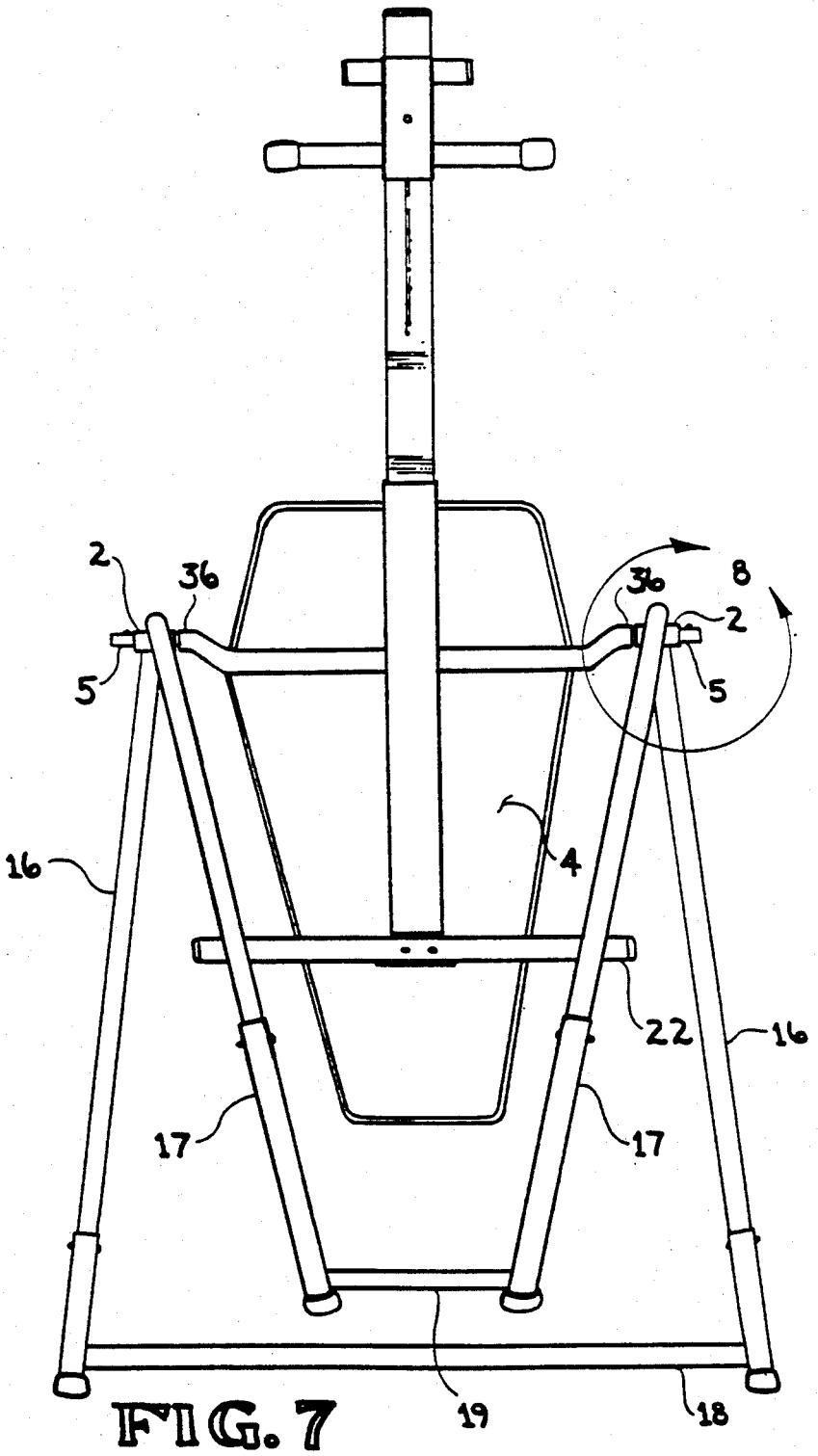
FIG. 7 is a front elevation view of a tilt bed of FIG. 1 showing partial sectional views of the pivot bearings.

In FIG. 7 the front elevation view of the tilt bed exercise device according to the invention, shows the tilt bed in the inverted position and the stop bar 22 having passed through the posterior legs 16 and resting against the anterior legs 17. Cross bars 18 and 19 support the respective legs and urge pivot bearings 2 against respective trust portions 36 of journals 5.

Figure 8:
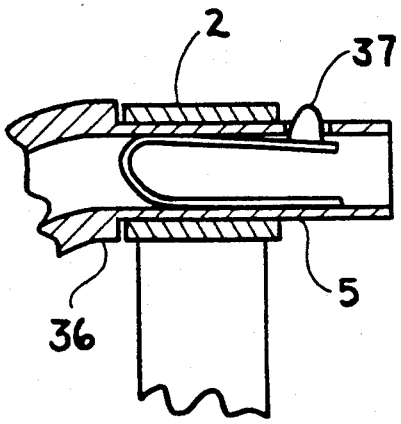
FIG. 8 is an enlarged view of a pivot bearing and journal in view 8 of FIG. 7.

In FIG. 8 journal 5 is shown with pivot bearing 2 against thrust bearing 36, and having a spring lock 37 to prevent loss of engagement event the bearing thrust load is overcome.

Figure 9:
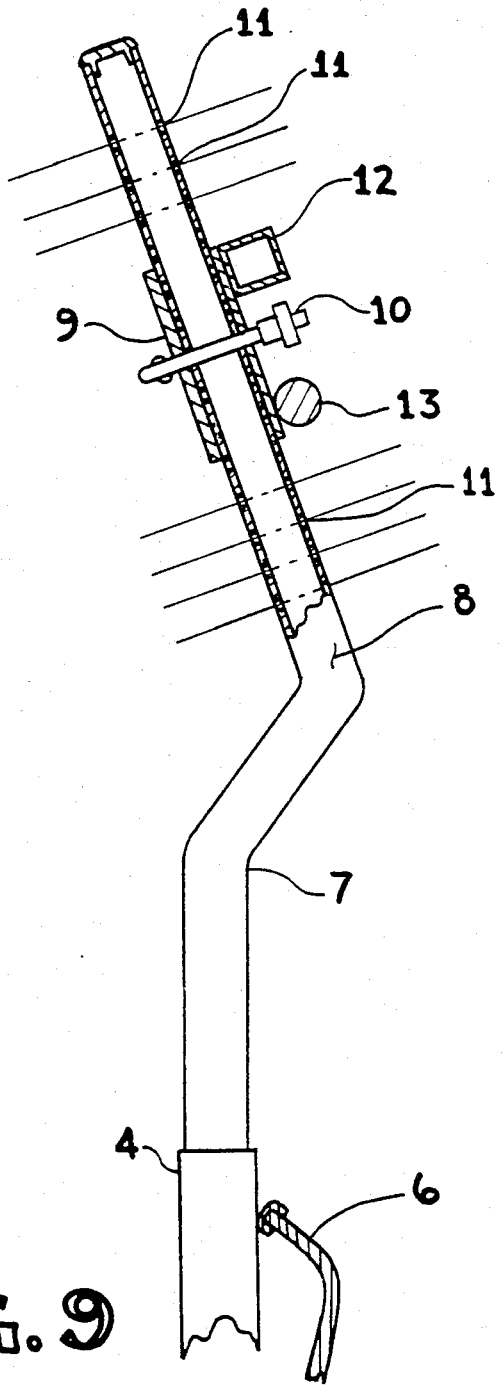
FIG. 9 is a side cross sectional view of the size adjustment mechanism of the tilt bed of FIG. 1.

In FIG. 9 beam 7 of tilt bed 4 is shown extending from torso support 6 in the inverted position. Rail 8 supports the foot support 9, in turn supporting foot rest 12 and foot bar 13. Foot support 9 is slidable on rail 8, and may be loaded along rail 8 by a locking pin 10 passing through at least one wall of rail 8 and one of a plurality of holes 11 in at least one wall of rail 8.

Figure 10:
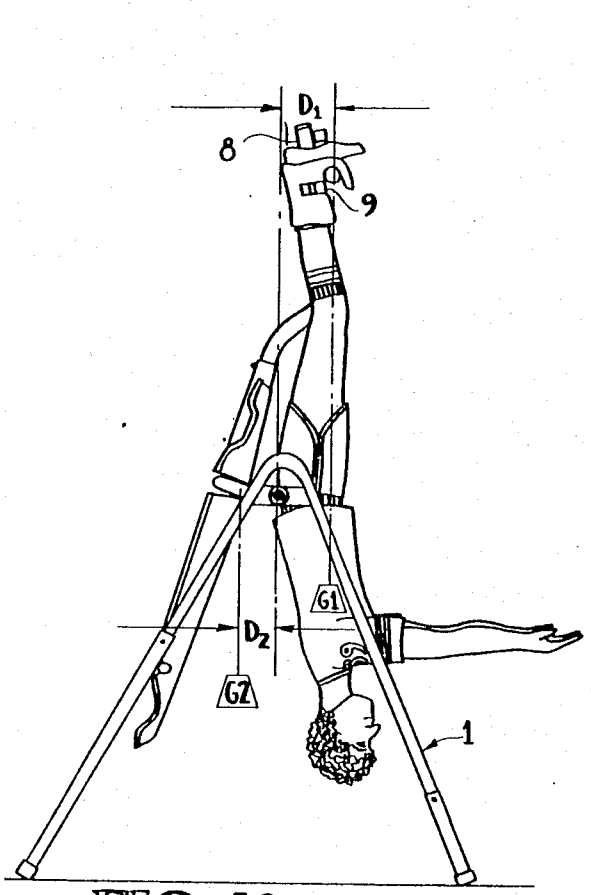
FIG. 10 is a side elevation view of the tilt bed according to the invention with a user of large size.

In FIG. 10 a user of large size is shown in inverted posture on the tilt bed exercise device 1 with foot support 9 adjusted to the distal end of rail 8, whereat distance $D_1$ is small and the product of $D_1$ times $G_1$ is only slightly greater than the product of $D_2$ times $G_2$, and the user is stable in inverted posture.

Figure 11:
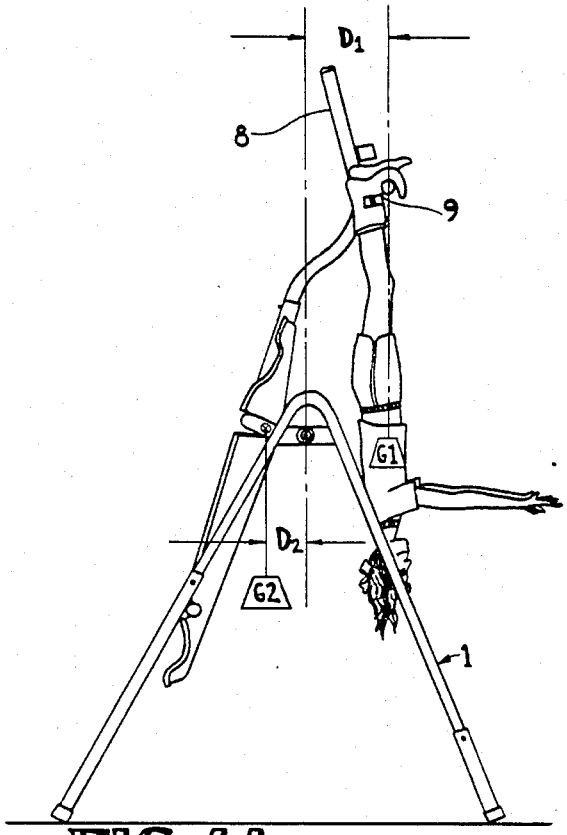
FIG. 11 is a side elevation view of the tilt bed according to the invention with a user of small size.

In FIG. 11 a user for small size is shown in inverted posture on the tilt bed exercise device 1 with foot support 9 adjusted to the proximal end of rail 8, whereat distance $D_1$ is large and the product of $D_1$ times $G_1$ is also slightly greater than the product of $D_2$ times $G_2$, and the user is stable in inverted posture.

The simplicity of the disclosed structure and adjustment system compared to the prior art devices results in a versatility of user size not previously available, and a reliability of getting into and returning from inverted posture that represents a dramatic improvement over the prior art.

I claim:

1. An exercise device comprising:

(a) a pair of spaced apart pivot bearings;

(b) means for supporting said pivot bearings in a coaxial relationship parallel to and spaced above a floor surface;

(c) a tilt bed disposed between said pivot bearings and pivotally mounted therein at its approximate midpoint, and an extension means extending longitudinally from the lower end thereof;

(d) ankle holding means attached to said extension means for the secure attachment of a user's ankles to said tilt bed;

(e) a pivot stop means wherein said tilt bed supporting the user may be rotated to a stop position with said ankle holding means rotated past the vertical plane through the axis of said pivot bearings;

(f) adjustment means on said tilt bed which allows said ankle holding means to be selectively longitudinally positioned with respect to said pivot bearings so that said ankle holding means can be positioned over a range of locations relative to said vertical plane when said tilt bed is at said stop position, said range being from a fixed distal position wherein said ankle holding means is closest to said vertical plane through the axis of said pivot bearings to a fixed proximal position wherein said ankle holding means is farthest away from said vertical plane through the axis of said pivot bearings.

2. An exercise device comprising, a pair of spaced apart pivot bearings, a frame for supporting said pivot bearings in a coaxial relationship parallel to and spaced above a floor surface, said frame having two anterior legs and two posterior legs wherein the anterior legs are spaced closer than the posterior legs, a tilt bed disposed between said pivot bearings and pivotally mounted therein at its approximate midpoint;

a beam extending from the lower end of said tilt bed terminating in an elongated rail adapted to be disposed between the ankles of a user;

a foot supporting means attached to said rail; and pivot stop bar means extending laterally outwardly from opposite sides of said bed adapted to pass between said posterior legs and to strike said anterior legs of said frame and stop rotation of said tilt bed whereby said tilt bed supporting a user may be rotated to a stop position with said foot supporting means rotated past the vertical plane through the axis of said pivot bearings.

* * * * *